US010132130B2

(12) United States Patent
Haworth

(10) Patent No.: US 10,132,130 B2
(45) Date of Patent: Nov. 20, 2018

(54) COMBUSTOR FOR HEATING OF AIRFLOW ON A DRILL RIG

(71) Applicant: Harnischfeger Technologies, Inc., Wilmington, DE (US)

(72) Inventor: Samuel F. Haworth, Oak Creek, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 4 days.

(21) Appl. No.: 15/240,821

(22) Filed: Aug. 18, 2016

(65) Prior Publication Data

US 2017/0051569 A1 Feb. 23, 2017

Related U.S. Application Data

(60) Provisional application No. 62/206,458, filed on Aug. 18, 2015.

(51) Int. Cl.

| | |
|---|---|
| ***E21B 21/16*** | (2006.01) |
| *E21B 36/00* | (2006.01) |
| *F04C 18/16* | (2006.01) |
| *F04C 29/00* | (2006.01) |
| *E21B 41/00* | (2006.01) |
| *E21B 7/02* | (2006.01) |

(52) U.S. Cl.

CPC ..... *E21B 21/16* (2013.01); *E21B 7/02* (2013.01); *E21B 36/00* (2013.01); *E21B 41/0078* (2013.01); *F04C 18/16* (2013.01); *F04C 29/0007* (2013.01)

(58) Field of Classification Search

CPC ..... E21B 21/16

See application file for complete search history.

(56) References Cited

U.S. PATENT DOCUMENTS

| | | | | |
|---|---|---|---|---|
| 3,172,487 | A * | 3/1965 | Klotz | E21B 7/14 175/17 |
| 4,061,197 | A * | 12/1977 | Skidmore, Jr. | E21B 4/14 175/101 |
| 4,549,856 | A | 10/1985 | Cash et al. | |
| 4,580,504 | A | 4/1986 | Beardmore et al. | |
| 4,682,471 | A | 7/1987 | Wagner | |
| 6,343,652 | B1 * | 2/2002 | Corre | E21B 23/14 166/302 |
| 7,735,935 | B2 | 6/2010 | Vinegar et al. | |
| 7,828,083 | B2 | 11/2010 | Sormunen et al. | |
| 7,841,407 | B2 | 11/2010 | Wellington et al. | |

(Continued)

FOREIGN PATENT DOCUMENTS

| | | |
|---|---|---|
| WO | 1996003566 | 2/1996 |
| WO | 2012026875 | 3/2012 |

OTHER PUBLICATIONS

PCT/US2016/047604 International Search Report and Written Opinion dated Nov. 7, 2016 (14 pages).

*Primary Examiner* — Giovanna C. Wright
*Assistant Examiner* — Kristyn A Hall
(74) *Attorney, Agent, or Firm* — Michael Best & Friedrich LLP

(57) ABSTRACT

A blasthole drill rig includes a base, a drill tower extending from the base, a drill pipe coupled to the drill tower, a drill bit coupled to a lower end of the drill pipe, an air compressor that directs compressed air through the drill pipe, and a heating element that heats the compressed air.

12 Claims, 4 Drawing Sheets

(56) References Cited

U.S. PATENT DOCUMENTS

| | | | | |
|---|---|---|---|---|
| 8,151,877 | B2 | 4/2012 | Kaminsky et al. | |
| 8,151,903 | B2 | 4/2012 | Crawford et al. | |
| 8,261,823 | B1 | 9/2012 | Hill et al. | |
| 8,608,249 | B2 | 12/2013 | Vinegar et al. | |
| 8,646,549 | B2 | 2/2014 | Ledbetter et al. | |
| 2004/0173379 | A1* | 9/2004 | Leppanen | E21B 7/022 175/57 |
| 2007/0089907 | A1 | 4/2007 | Hartwig et al. | |
| 2007/0246262 | A1 | 10/2007 | Brookover | |
| 2007/0248454 | A1 | 10/2007 | Davis et al. | |
| 2011/0048703 | A1 | 3/2011 | Farshchian et al. | |
| 2011/0247816 | A1 | 10/2011 | Carter, Jr. | |
| 2011/0286861 | A1 | 11/2011 | Field et al. | |
| 2012/0279222 | A1 | 11/2012 | Sigworth, Jr. et al. | |
| 2013/0319765 | A1 | 12/2013 | Piipponen et al. | |

* cited by examiner

COMBUSTOR FOR HEATING OF AIRFLOW ON A DRILL RIG

CROSS-REFERENCE TO RELATED APPLICATIONS

This application claims priority to U.S. Provisional Application No. 62/206,458, filed Aug. 18, 2015, the entire contents of which are incorporated herein by reference.

FIELD OF THE INVENTION

The present invention relates to drill rigs, and more specifically to an air compressor and air flushing for use with a blasthole drill rig.

Blasthole drill rigs are commonly used in the mining industry to drill through hard rock. Blasthole drill rigs can be found, for example, in coal, copper, and diamond mines throughout the world. A blasthole drill rig typically includes a base, a drill tower extending vertically from the base, and a drill pipe or pipes that are coupled to and supported by the drill tower, and extend into a borehole. The blasthole drill rig also includes an air compressor (e.g., an oil flooded rotary screw air compressor) driven by a diesel engine, that directs compressed air (e.g., at 100 psi) into the borehole to flush bit cuttings and other loose material from the bottom of the borehole to the surface. Current blasthole drill rigs use a substantial supply of compressed air to clear the loose material out of the borehole as a bit is progressed downward. While some drill rigs use water or mud as flushing fluids instead of air, air has proven more advantageous for blasthole drills because it does not need to be transported and stored. However, current blasthole drill rigs utilize the majority of their fuel consumption to produce compressed air, which adversely affects operating costs. Therefore, there is a desire to decrease the fuel required for generating compressed air.

SUMMARY

In accordance with one construction, a blasthole drill rig includes a base, a drill tower extending from the base, a drill pipe coupled to the drill tower, a drill bit coupled to a lower end of the drill pipe, an air compressor that directs compressed air through the drill pipe, and a heating element that heats the compressed air.

In accordance with another construction, a method of operating a blasthole drill rig includes directing compressed air through a drill pipe with an air compressor so as to flush bit cuttings from a bottom of a borehole, and heating the compressed air with a heating element.

In accordance with another construction, a drill pipe for a blasthole drill rig includes a body having an upper end and a lower end. The body defines an internal cavity for movement of air between the upper end and the lower end. The drill pipe also includes a plurality of vent apertures spaced between the upper end and the lower end along the body, wherein each of the plurality of vent apertures extends through the body and is in communication with the internal cavity.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
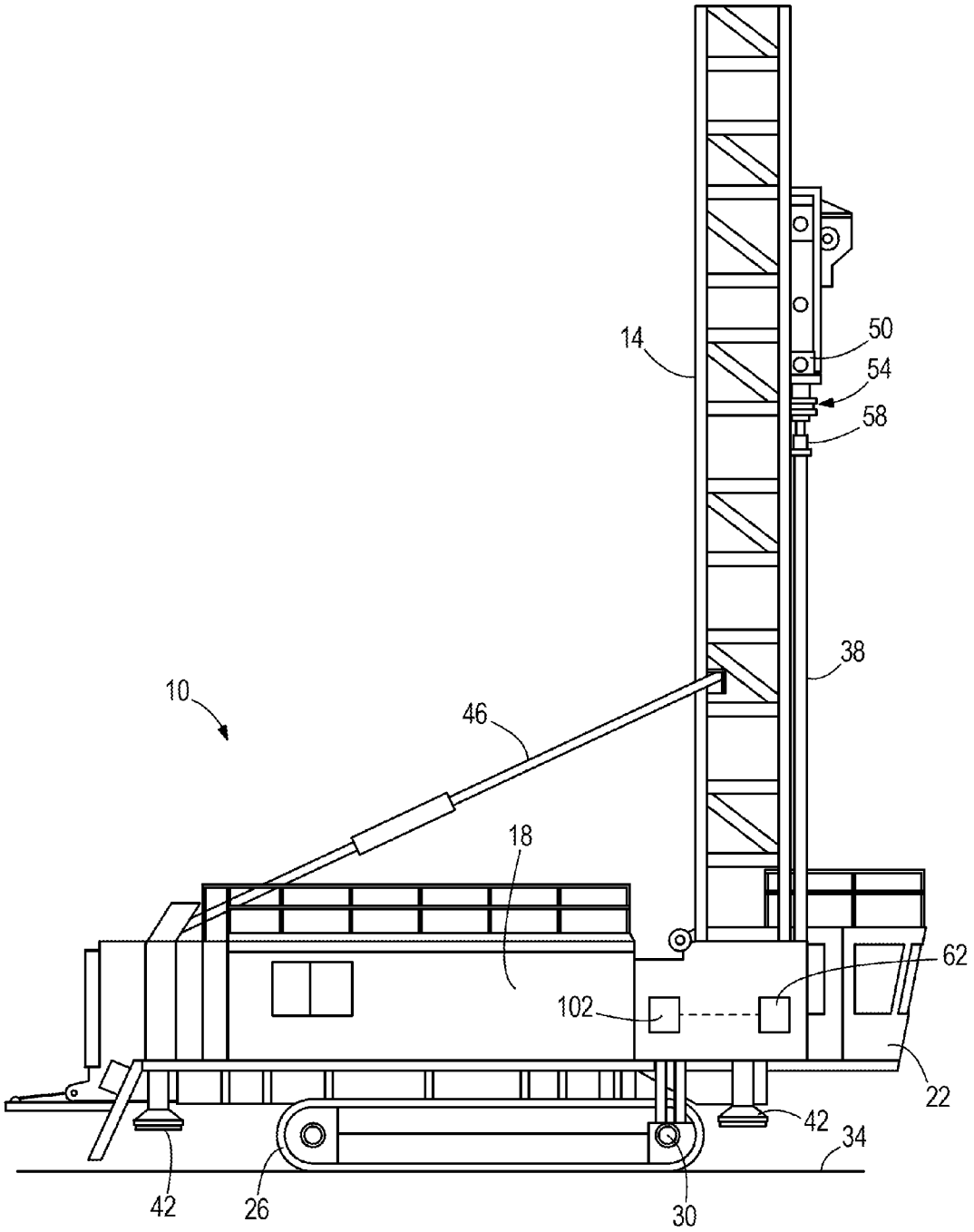
FIG. 1 is a side view of a blasthole drill rig according to one embodiment.

With reference to FIG. 1, a blasthole drill rig 10 is shown as having a drill tower 14, a base 18 (e.g., a machinery house) beneath the drill tower 14 that supports the drill tower 14, an operator's cab 22 coupled to the base 18, and crawlers 26 driven by a crawler drive 30 that drive the drill rig 10 along a ground surface 34. The drill tower 14 is coupled to and supports at least one drill pipe 38, which is configured to extend vertically downward through the ground 34 and into a borehole. In some constructions, and as illustrated in FIG. 3, multiple drill pipes 38 are connected together to form an elongated drill string or overall drill pipe that extends into the borehole.

The drill rig 10 includes leveling jacks 42 to support the drill rig 10 on the surface 34, a brace 46 that supports the drill tower 14 on the machinery house 18, a drill head motor 50 that drives a rotary drill head 54, and a coupling 58 that couples together the rotary drill head 54 with an upper end of one of the drill pipes 38. The drill rotary drill head 54 is selectively engageable with the upper end of the drill pipe 38 (e.g., via the coupling 58 being screwed onto the upper end of the drill pipe 38), and is movable vertically up and down the mast 14 (e.g., with rollers).

Figure 2:
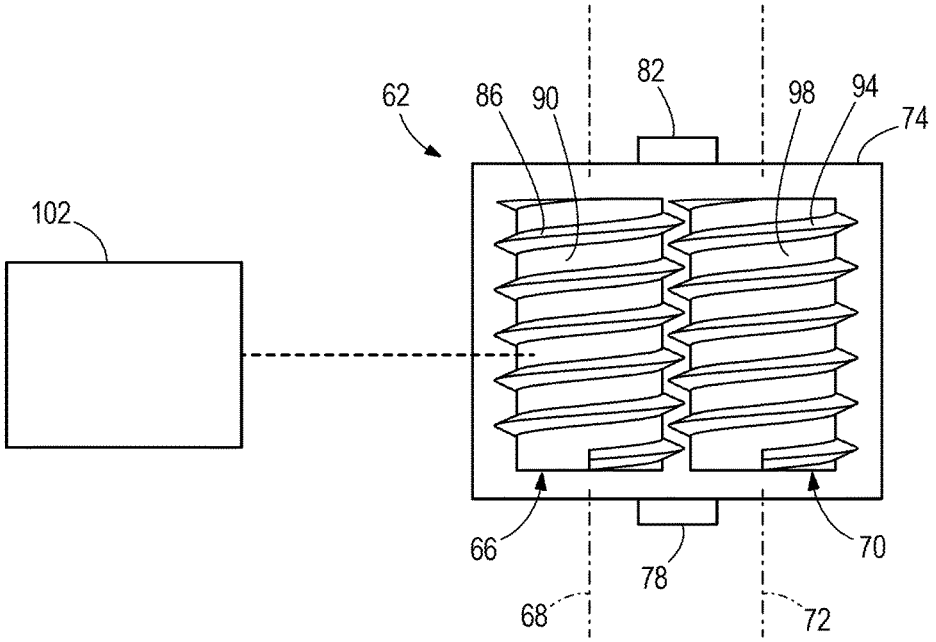
FIG. 2 is a schematic view of the air compressor.
Figure 3:
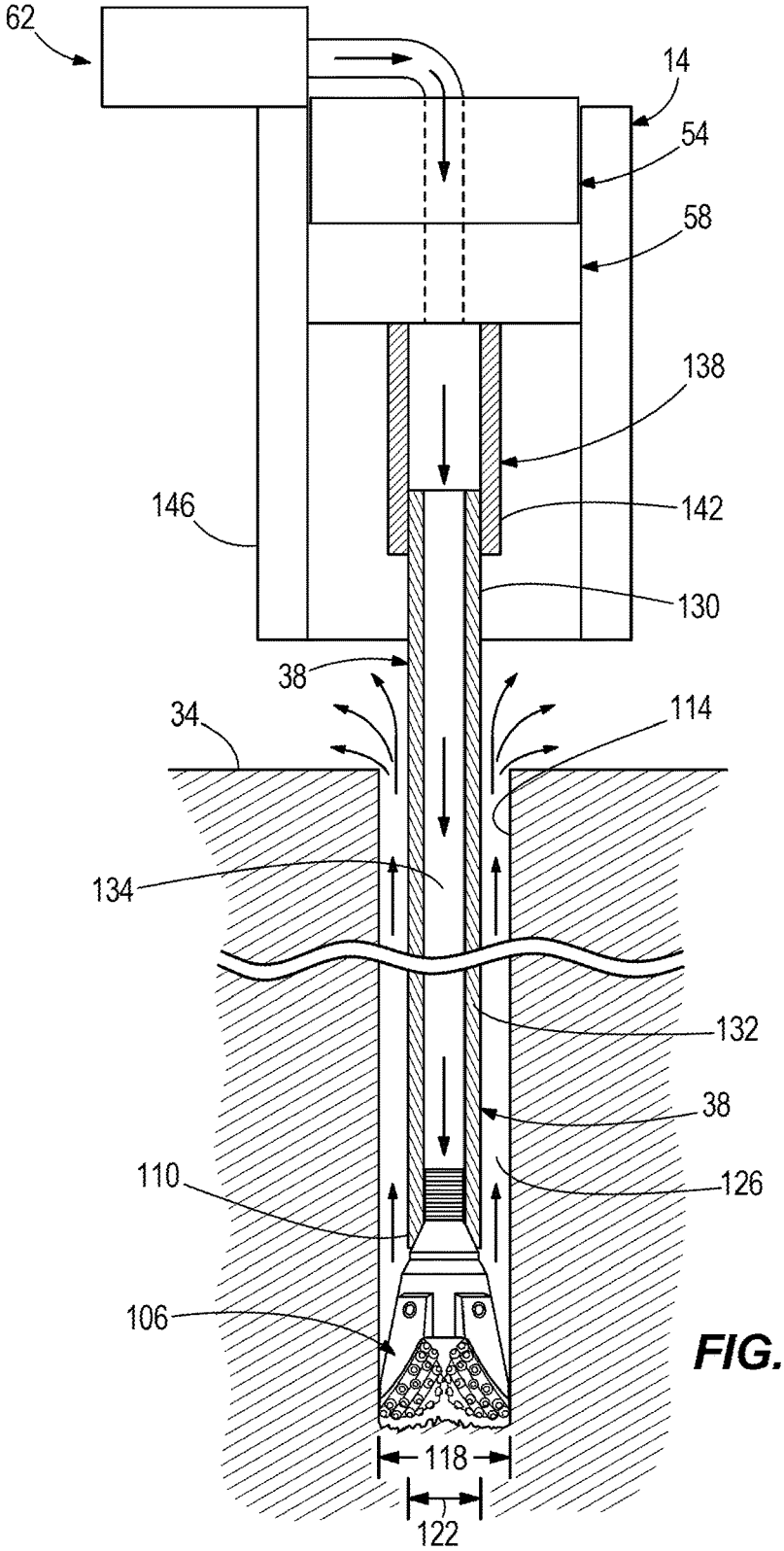
FIG. 3 is a schematic view of a drill pipe, an air compressor, and a heating element of the blasthole drill rig of FIG. 1, illustrating air entering and leaving a borehole drilled by the drill pipe and being heated by the heating element upon entering the borehole.

With reference to FIGS. 1-3, the drill rig 10 further includes an air compressor 62 (e.g., disposed within the machinery house 18) for flushing bit cuttings from the bottom of the borehole to the surface. In the illustrated construction, the air compressor 62 is an oil flooded rotary screw air compressor, although other constructions include different types of air compressors.

As illustrated in FIG. 2, the air compressor 62 is a lubricant-injected, rotary screw compressor that includes a main rotor 66 that rotates about an axis 68 and a secondary rotor 70 that rotates about an axis 72, both disposed in a stator housing 74. The stator housing 74 includes an air inlet port 78 and an air outlet port 82. The main rotor 66 has helical lobes 86 and grooves 90 along its length, while the secondary rotor 70 has corresponding helical lobes 94 and grooves 98. Air flowing in through the inlet port 78 fills spaces between the helical lobes 86, 94 on each rotor 66, 70. Rotation of the rotors 66, 70 causes the air to be trapped between the lobes 86, 92 and the stator housing 74. As rotation continues, the lobes 86 on the main rotor 66 roll into the grooves 98 on the secondary rotor 70 and the lobes 94 on the secondary rotor 70 roll into the grooves 90 on the main rotor 66, thereby reducing the space occupied by the air and resulting in increased pressure. Compression continues until the inter-lobe spaces are exposed to the air outlet port 82 where the compressed air is discharged. Lubricant is injected into the stator housing 74 during the compression of the air. The lubricant lubricates the intermeshing rotors 66, 70 and associated bearings (not shown). In the illustrated construction the air compressor 62 is driven by a prime mover 102.

With reference to FIG. 3, the drill rig 10 includes a drill bit 106 coupled to a lower end 110 of a bottom drill pipe 38. The drill bit 106 is used to drill through the ground surface 34 and into the ground, thereby forming a borehole 114 in the ground. In the illustrated construction, the drill bit 106 is a tri-cone drill bit, although other constructions include different drill bits. The drill bit 106 has a width or diameter 118 that is larger than a width or diameter 122 of one or more of the drill pipes 38, such that a gap 126 is formed around the drill pipe or pipes 38 as the drill bit 106 moves downward through the ground surface 34 and into the ground.

As illustrated in FIG. 3, the rotary drill head 54 and coupling 58 are coupled to an upper end 130 of a top drill pipe 38, above the ground surface 34. Each drill pipe 38 includes a body 132 that defines an internal cavity 134 forming a through-hole through the interior of the drill pipe 38. Compressed air from the air compressor 62 is directed through the internal cavities 134 down to the drill bit 106 (as illustrated by the arrows in FIG. 3), where the air is released out of the bottom drill pipe 38 and into the borehole 114 to clear any loose material out of the borehole 114 as the drill bit 106 is progressed downward. The compressed air then travels back up along the gap 126, flushing the loose material out of the borehole 114. In some constructions the compressed air cools the drill bit 106 as the compressed air passes over or around the drill bit 106.

The drill rig 10 further includes a heating element 138 that directly heats the compressed air. In the illustrated construction, the heating element 138 is a combustor having a body 142 that is coupled (e.g., releasably coupled) to the upper end 130 of the top drill pipe 38, directly below and adjacent the rotary drill head 54 and coupling 58. In other constructions, the heating element 138 is coupled to the rotary drill head 54, to the coupling 58, to a lower end 146 of the drill tower 14, or to other locations on the drill rig 10 (e.g., anywhere between the air compressor 62 and the drill bit 106). In some constructions, the heating element 138 is movable along the drill pipes 38, such that the heating element 138 may be relocated or repositioned along the drill pipes 38 as desired. In some constructions, the heating element 138 is disposed between the rotary drill head 54 and the drill bit 114.

In the illustrated construction, the heating element 138 is fueled by the same fuel source that is used to fuel the prime mover 102. However, in other constructions the heating element 138 has its own, separate fuel source. In the illustrated construction, the heating element 138 is a combustor that receives and ignites fuel so as to generate heat. The generated heat is directed toward the compressed air that is entering the internal cavity 134. By warming the compressed air, the effective pressure and flowrate of the compressed air is increased, thereby reducing the amount of work and fuel required by the air compressor 62 to generate a continuous airflow into and out of the borehole 114 and to flush material out of the borehole 114. The direct heating of the airflow with the heating element 138 increases the effective pressure and flow rate of the airflow more efficiently than with the mechanical air compressor 62 alone. This allows the size of the air compressor 62 to be decreased, if desired, also resulting in a net decrease in fuel required for generating the flushing air stream.

While the illustrated heating element 138 is a combustor, in some constructions the heating element 138 is an electrical heating element, an air-to-air heat exchanger using diesel engine exhaust heat, a concentrated solar heater, or any other heating element. Additionally, while the heating element 138 is illustrated at the upper end 130 of a top drill pipe 38, in some constructions the heating element 138 is located at other locations. For example, in constructions where the heating element 138 is an air to air heat exchanger utilizing waste exhaust heat, the heating element 138 may be located in close proximity to a diesel engine. In such a construction, an air line from the heating element 138 to the upper end 130 of the top drill pipe 38 may be insulated to retain the heat until it was used. In constructions where the heating element 138 is an electric heater, the heating element 138 may be located in the same location as the combustor heating element 138 in FIG. 2, or at various other locations on the drill rig 10. In constructions where the heating element 138 is a solar thermal concentrator, the heating element 138 may include a reflector to concentrate solar energy onto a fluid filled receiver. A receiver fluid may then be used to heat the flow of compressed air. Because of the size involved with this type of construction, the location of the heating element 138 may be more limited based on where the heating element 138 would be most effective on the drill rig 10.

As noted above, it can be advantageous to also use the compressed air to cool the drill bit 106. Therefore, in the illustrated construction the heating element 138 is disposed well above the drill bit 106 (i.e., at the upper end 130 of the top drill pipe 38). In this construction the warming of the compressed air occurs where the air enters the top drill pipe 38, so that the compressed air is at its coolest point where it reaches the drill bit 106. However, in other constructions the heating element 138 is located closer to the drill bit 106 (e.g., even down within the borehole 114). In some constructions, the drill rig 10 includes a plurality of heating elements 138 (e.g., one disposed above the borehole 114 along the drill pipes 38 and another disposed within the borehole 114 along the drill pipes 38).

The direct heating of the airflow with the heating element 138 provides a robust and inexpensive design for effectively heating airflow used to flush material out of the borehole 114. In some constructions, the heating element 138 is easily coupled to existing drills as a retrofit, or is alternatively provided as a component of a newly manufactured drill rig.

Figure 4:
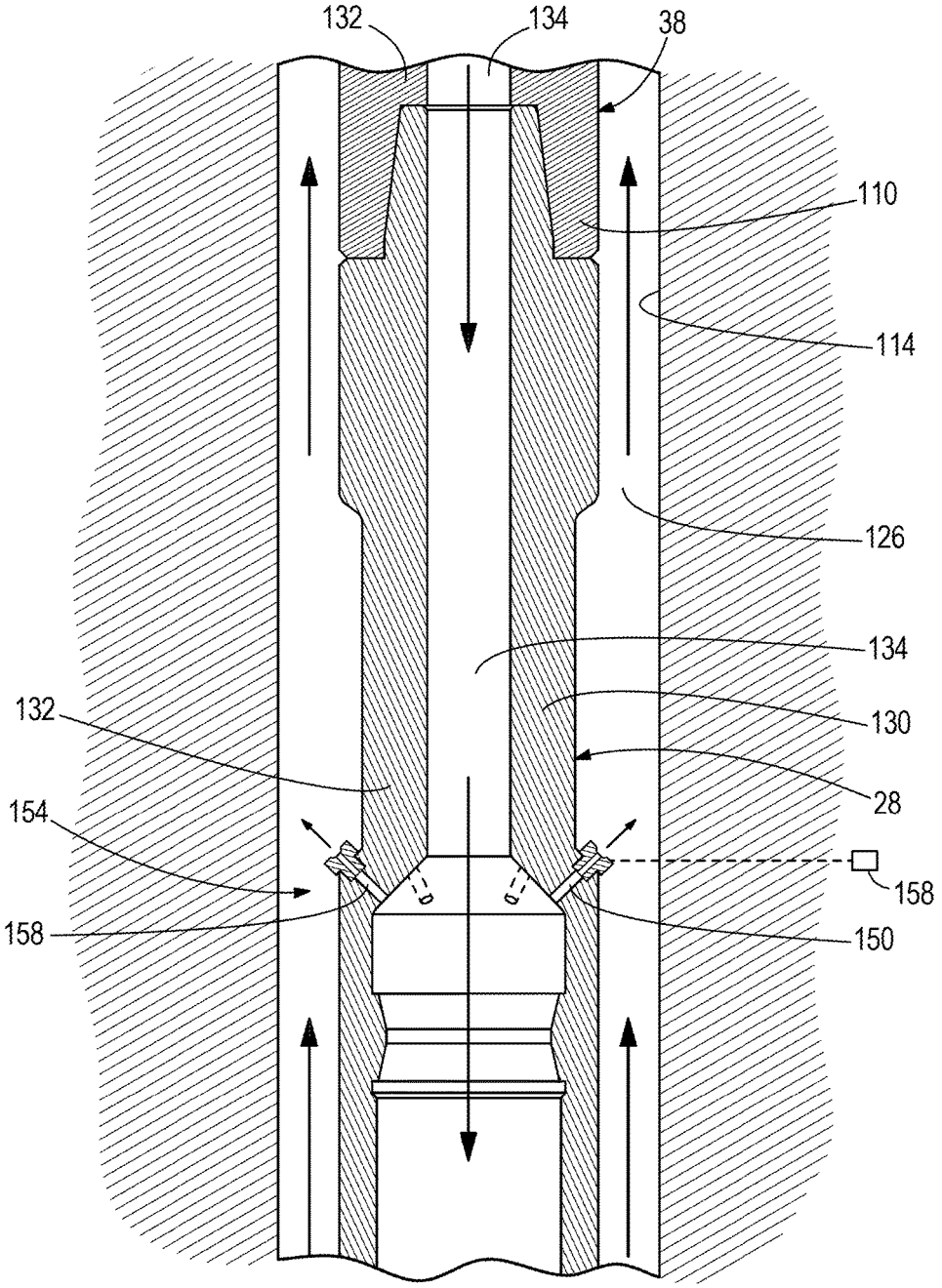
FIG. 4 is a schematic view of a portion of the drill pipe, illustrating vent apertures.

With reference to FIG. 4, in some constructions at least one of the drill pipes 38 additionally or alternatively includes vent apertures 150. The vent apertures 150 are spaced along the body 132 of the drill pipe 38. The vent apertures extend through the body 132 and are in communication with the internal cavity 134. In the illustrated construction, the bottom drill pipe 38 includes a discrete ringed section 154 of vent apertures 150 along its body 132, at the upper end 130 of the drill pipe 38. The illustrated construction includes six vent apertures 150 spaced generally equally around the drill pipe 38 (four being visible in FIG. 4), although other constructions include different numbers and arrangements of vent apertures 150. In some constructions, more than one ring of vent apertures 150 is provided. In some constructions, one or more of the vent apertures 150, or the ringed section 154 of vent apertures 150, are set at a specific, predefined location along the body 132 of the drill pipe 38 (e.g., at a predefined distance from the drill bit 106 or from the heating element 138).

With continued reference to FIG. 4, the vent apertures 150 allow heated air to pass out of the drill pipe 38 and into the gap 126 (see arrows in FIG. 4). This prevents the drill bit 106 from becoming overheated (e.g., due to heat passing down along the bodies 132 of the drill pipes 38 to the drill bit 106), and further facilitates heating of the airflow as the airflow rises up and exits out the borehole 114.

With continued reference to FIG. 4, in some constructions one or more nozzles 158 are also provided (one nozzle 158 being schematically illustrated in FIG. 4). The nozzles 158 fit into the vent apertures 150 (e.g., via a threaded screw-in or press-fit geometry) and control the amount or rate of compressed air that leaves the vent apertures 150. In some constructions, the nozzles 158 are removable. In some constructions, one or more of the nozzles 158 includes a larger opening for airflow than another one of the nozzles 158, so as to provide a different amount or rate of flow of compressed air. In some constructions, the size of the nozzles 158 (e.g., the size of the openings in the nozzles for air flow) depends on a nozzle or aperture size in the drill bit 106 and/or conditions that the drill rig 10 is operating in. In some constructions, the vent apertures 150 bleed approximately 20% of the compressed air passing along the internal cavities 134 out into the gap 126, although other constructions include different bleed amounts.

Although the invention has been described in detail with reference to certain preferred embodiments, variations and modifications exist within the scope and spirit of one or more independent aspects of the invention as described.

What is claimed is:

1. A blasthole drill rig comprising:

a base;

a drill tower extending from the base;

a drill head motor coupled to the drill tower;

a rotary drill head coupled to the drill head motor;

a drill pipe coupled to the drill tower;

a drill bit coupled to a lower end of the drill pipe;

an air compressor that directs compressed air through the drill pipe to flush bit cuttings from a bottom of a borehole;

a heating element that heats the compressed air, wherein the heating element is a combustor coupled to an upper end of the drill pipe below the rotary drill head;

a prime mover that moves the air compressor, wherein the prime mover is fueled by a fuel source, wherein the combustor is fueled by the same fuel source as the prime mover.

2. The blasthole drill rig of claim 1, wherein the upper portion of the drill pipe remains exposed above ground during drilling operations.

3. The blasthole drill rig of claim 1, wherein the heating element is movable along the drill pipe.

4. The blasthole drill rig of claim 1, wherein the drill pipe includes an internal cavity, wherein the air compressor is configured to direct the compressed air through the internal cavity, and wherein the heating element is configured to generate heat and to direct the heat toward compressed air that is entering the internal cavity.

5. The blasthole drill rig of claim 1, wherein the drill pipe includes a plurality of vent apertures that provide a pathway for the compressed air to escape out of the drill pipe and into a gap around the drill pipe within a borehole.

6. A method of operating a blasthole drill rig, the method comprising:

directing fuel from a fuel source to a prime mover, the prime mover coupled to an air compressor;

directing compressed air through a drill pipe with the air compressor;

flushing bit cuttings from a bottom of a borehole with the compressed air that has been directed through the drill pipe;

reducing an amount of fuel directed to the prime mover by heating the compressed air with a heating element before the compressed air exits the drill pipe; and venting compressed air out of the drill pipe through vent apertures along the drill pipe.

7. The method of claim 6, wherein the step of heating the compressed air includes heating the compressed air before the compressed air enters the borehole.

8. The method of claim 6, wherein the heating element is a combustor.

9. The method of claim 8, further comprising directing fuel from the fuel source to both the prime mover and the combustor.

10. The method of claim 6, wherein the heating element is disposed at an upper end of the drill pipe, and wherein the method further includes cooling a drill bit at a bottom end of the drill pipe with the compressed air.

11. The method of claim 6, further comprising moving the heating element along the drill pipe.

12. The method of claim 6, wherein the air compressor is a second air compressor and has a second size, wherein the method includes removing a first air compressor from the blasthole drill rig and replacing the first air compressor with the second air compressor, wherein the first air compressor has a first size that is larger than the second size.

* * * * *